US006354853B1

(12) United States Patent
Matsuzaki et al.

(10) Patent No.: US 6,354,853 B1
(45) Date of Patent: Mar. 12, 2002

(54) ROTARY CONNECTOR

(75) Inventors: Nobuo Matsuzaki; Hiroyuki Bannai, both of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/567,902

(22) Filed: May 10, 2000

(30) Foreign Application Priority Data

May 11, 1999 (JP) ..... 11-130342

(51) Int. Cl.[7] ..... H01R 35/04
(52) U.S. Cl. ..... 439/164
(58) Field of Search ..... 439/164, 15

(56) References Cited

U.S. PATENT DOCUMENTS 5,562,466 A 10/1996 Kato et al. ..... 439/164
5,683,260 A 11/1997 Kato et al. ..... 439/164
5,702,260 A 12/1997 Kato et al. ..... 439/164

*Primary Examiner*—Gary Paumen
(74) *Attorney, Agent, or Firm*—Brinks Hofer Gilson & Lione

(57) ABSTRACT

Lead blocks are connected to end portions of flexible cables and are held at predetermined positions of housings. The lead blocks are each composed of a body portion, an extending terminal portion, and a conductor extending portion. A connecting portion for the associated flexible cable is formed in only the body portion. A predetermined number of connecting terminals are distributed to the body portion and the extending terminal portion. According to this configuration, conductors carried in the flexible cables and conductors held in the lead blocks can be connected with each other without dividing end portions of the flexible cables. Besides, it is possible to increase the total number of connecting terminals without increasing the number of lead blocks. Thus, it is possible to realize a multi-circuit configuration of the rotary connector.

7 Claims, 5 Drawing Sheets

ROTARY CONNECTOR

BACKGROUND OF THE INVENTION

1. Field of the Invention

The present invention relaters to a rotary connector incorporated in a vehicular steering system and functioning to provide an electrical connection between an electric device disposed on the rotor side and an electric device disposed on the stator side.

2. Description of the Prior Art

This type of a rotary connector is mainly composed of a pair of housings disposed concentrically and connected together in a relatively rotatable manner and a flexible cable received in a windable and rewindable manner into a space formed between the paired housings. Both end portions of the flexible cable are fixed to the housings respectively and then are drawn out electrically to the exterior usually through lead wires. Of the paired housings, one is used as a movable housing and the other as a fixed housing. As the movable housing is turned clockwise or counterclockwise, the flexible cable is wound or rewound within the aforesaid space.

In the rotary connector thus constituted schematically, the fixed housing is fixed to a steering column of a steering system, while the movable housing is fixed to a steering wheel, and both ends of the flexible cable are connected respectively to an electric device disposed on the steering column side and an electric device disposed on the steering wheel side. In this state the rotary connector is used as an electrical connector means for, say, a air bag system or a horn circuit.

A rotary connector that has been becoming most popular in recent years is of the type in which, for facilitating and ensuring the connection between conductors carried within a flexible cable and lead wires connected to electric devices disposed on the steering column side and the steering wheel side, cable connectors called lead blocks are connected to end portions of the flexible cable and are fixed to a part of a fixed housing and a part of a movable housing, and external connectors connected to end portions of the lead wires are mounted to the lead blocks, thereby connecting the conductors carried in the flexible cable and the lead wires with each other electrically.

The vehicular steering system has recently become multi-functional, with consequent tendency to an increase in the number of circuits. However, if the tendency to such a multi-circuit configuration is promoted, the length of a lead block, if the lead block is of a mere single row arrangement of connecting terminals, becomes too large, causing an obstacle to its accommodation into a housing or giving rise to the problem that the size of a rotary connector used becomes large. In the conventional rotary connector, to cope with an increase in the number of conductors incorporated in a flexible cable, a plurality of lead blocks are connected to a single flexible cable or there is used a lead block with connecting terminals arranged in plural rows.

However, according to the former countermeasure just mentioned above, it is necessary that an end portion of the flexible cable be divided and that conductors carried in the thus-divided portions be connected to a plurality of lead blocks, while according to the latter countermeasure, it is necessary that an end portion of the flexible cable be divided and that conductors carried in the thus-divided portions be connected respectively to the plural rows in a single lead block. Thus, in both cases it is necessary to divide an end portion of the flexible cable and make connection to a lead block(s), but work for connection between the flexible cable and the lead block(s) is complicated. In the former case, moreover, since the number of lead blocks increases, the work for connecting lead blocks with external connectors after mounting the rotary connector to the steering system also becomes complicated.

The present invention has been accomplished for solving the above-mentioned problems of the prior art and it is an object of the invention to provide a rotary connector which, even with an increase in the number of conductors carried in a flexible cable, permits the work for connection between the flexible cable and lead blocks to be carried out easily and which also permits the work for connection between lead blocks and external connectors or external leads to be done easily.

SUMMARY OF THE INVENTION

According to the present invention, for achieving the above-mentioned object, there is provided a rotary connector comprising a pair of housings disposed concentrically and connected together in a relatively rotatable manner, a flexible cable received in a windable and rewindable manner within a space formed between the paired housings, and a lead block connected to an end portion of the flexible cable and held at a predetermined position of the housings, the lead block comprising a body portion, one or plural conductor extending portions projecting from the body portion, and an extending terminal portion, the body portion having a flexible cable connecting portion as a connection of conductors carried in the flexible cable and a group of connecting terminals integral with some of the conductors which constitute the connecting portion, the conductor extending portion(s) being integral with some of the remaining conductors which constitute the connecting portion, and the extending terminal portion having a connecting terminal or a group of connecting terminals integral with a conductor or a group of conductors which constitute the conductor extending portion(s).

In the rotary connector of the above configuration, even if the total number of connecting terminals formed in the lead block increases with an increase in the number of conductors carried in the flexible cable, this can be coped with by providing a predetermined number of connecting terminals in the body portion and also in the extending terminal portion and by bending the conductor extending portion and disposing the extending terminal portion at an appropriate position. Therefore, an end portion of the flexible cable can be connected to the lead block (a connection of the conductors carried in the flexible cable) in a simple manner without dividing the cable end portion. Besides, since the extending terminal portion is connected to the body portion through the conductor extending portion and it is possible to increase the total number of output terminals even without increasing the number of lead block. Therefore, there is no fear that the external connector mounting work or the external lead connecting work for the lead block may become complicated.

For example, if a plurality of connecting terminals are provided in the extending terminal portion, if the conductor extending portion is bent and the extending terminal portion is turned back along the body portion, and if the connecting terminal group projected in a row from the body portion and the connecting terminal group projected in a row from the extending terminal portion are arranged in parallel with each other, then not only it is possible to arrange two rows of connecting terminals in a single lead block but also it is possible to connect an end portion of the flexible cable to the flexible cable connecting portion of the body portion without dividing the cable end portion.

Preferably, the connecting terminals provided in the body portion and the extending terminal portion are integrally molded using an insulating resin. This is for facilitating their handling and for fixing their preset intervals with a high accuracy. Further, for facilitating the connection with external connectors, it is preferable that each connecting terminal group be projected at a predetermined certain pitch from the resin molded portion.

Preferably, a positioning means for positioning the extending terminal portion relative to the body portion is provided between the body portion and the extending terminal portion. According to this positioning means it is possible to establish, with a high accuracy, a positional relation between a connecting terminal or a group of connecting terminals projected from the extending terminal portion and a group of connecting terminals projected from the body portion at the time of folding back the extending terminal portion along the body portion.

For facilitating the connection of the flexible cable it is particularly preferred that a group of conductors in a number corresponding to the number of conductors carried in the flexible cable be arranged in the flexible cable connecting portion of the body portion flushly at intervals corresponding to the intervals preset for the conductors carried in the flexible cable.

DETAILED DESCRIPTION OF A PREFERRED EMBODIMENT

Figure 1:
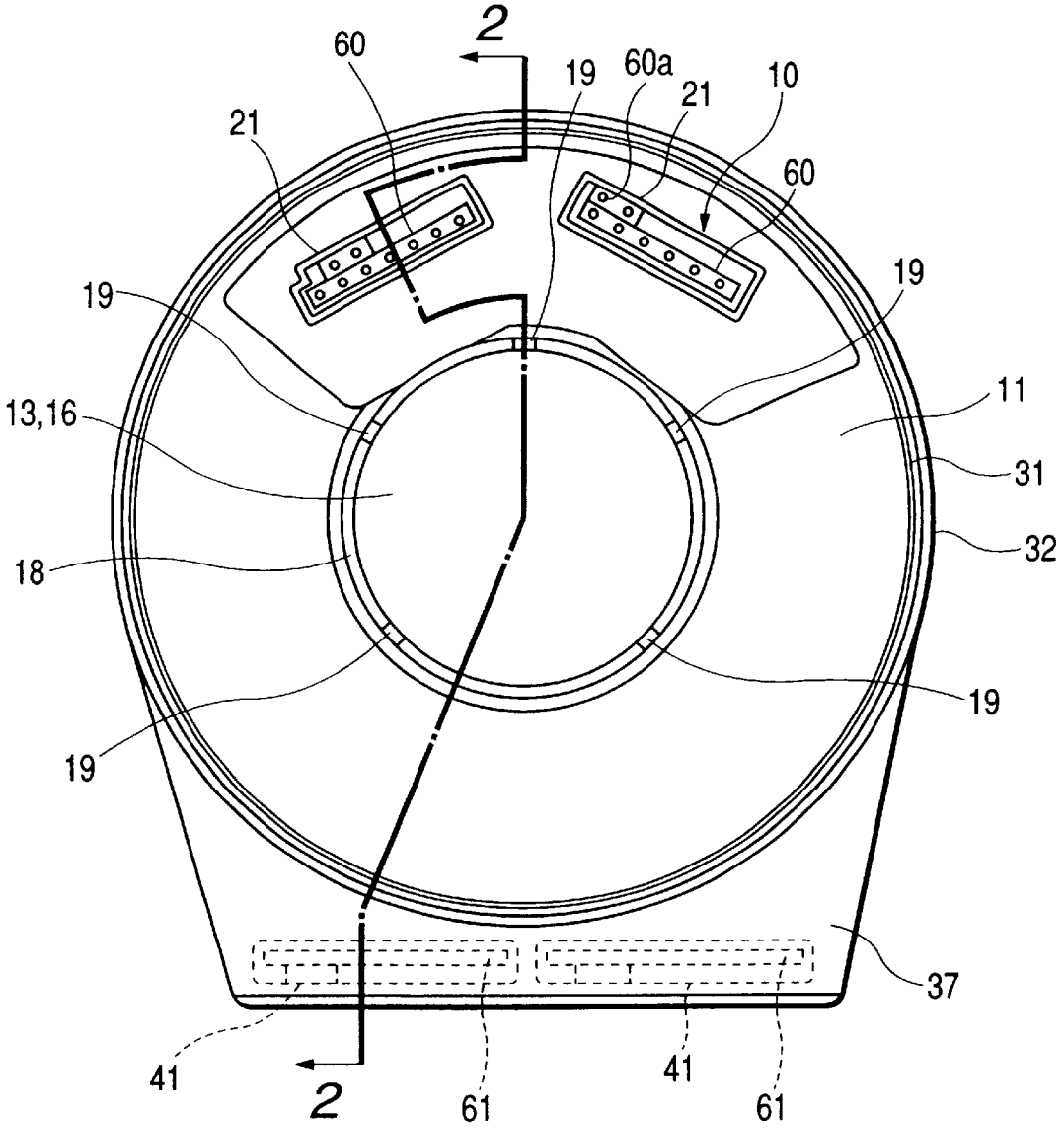
FIG. 1 is a plan view of a rotary connector according to an embodiment of the present invention.
Figure 2:
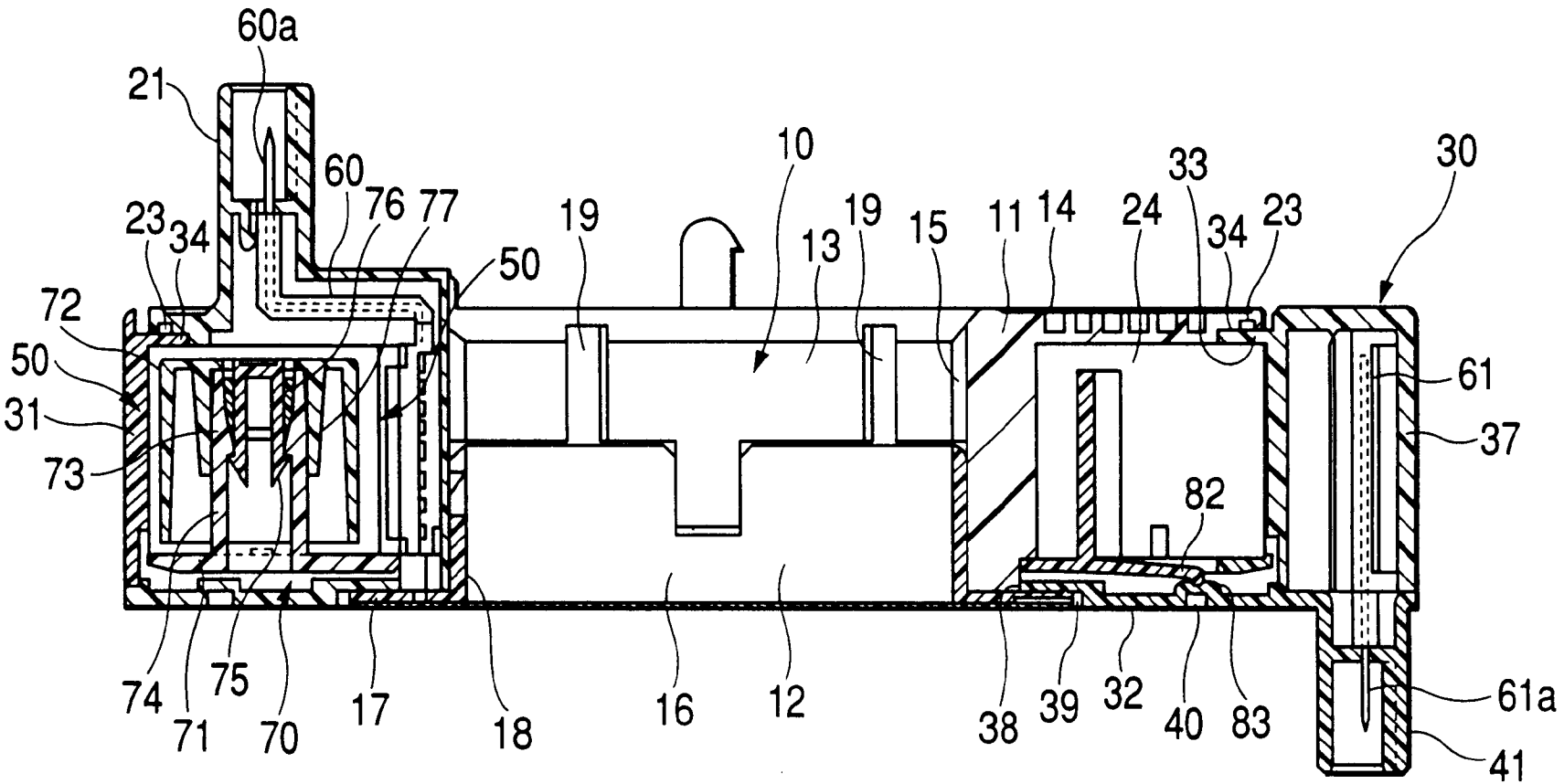
FIG. 2 is a sectional view taken on line 2—2 in FIG. 1.
Figure 3:
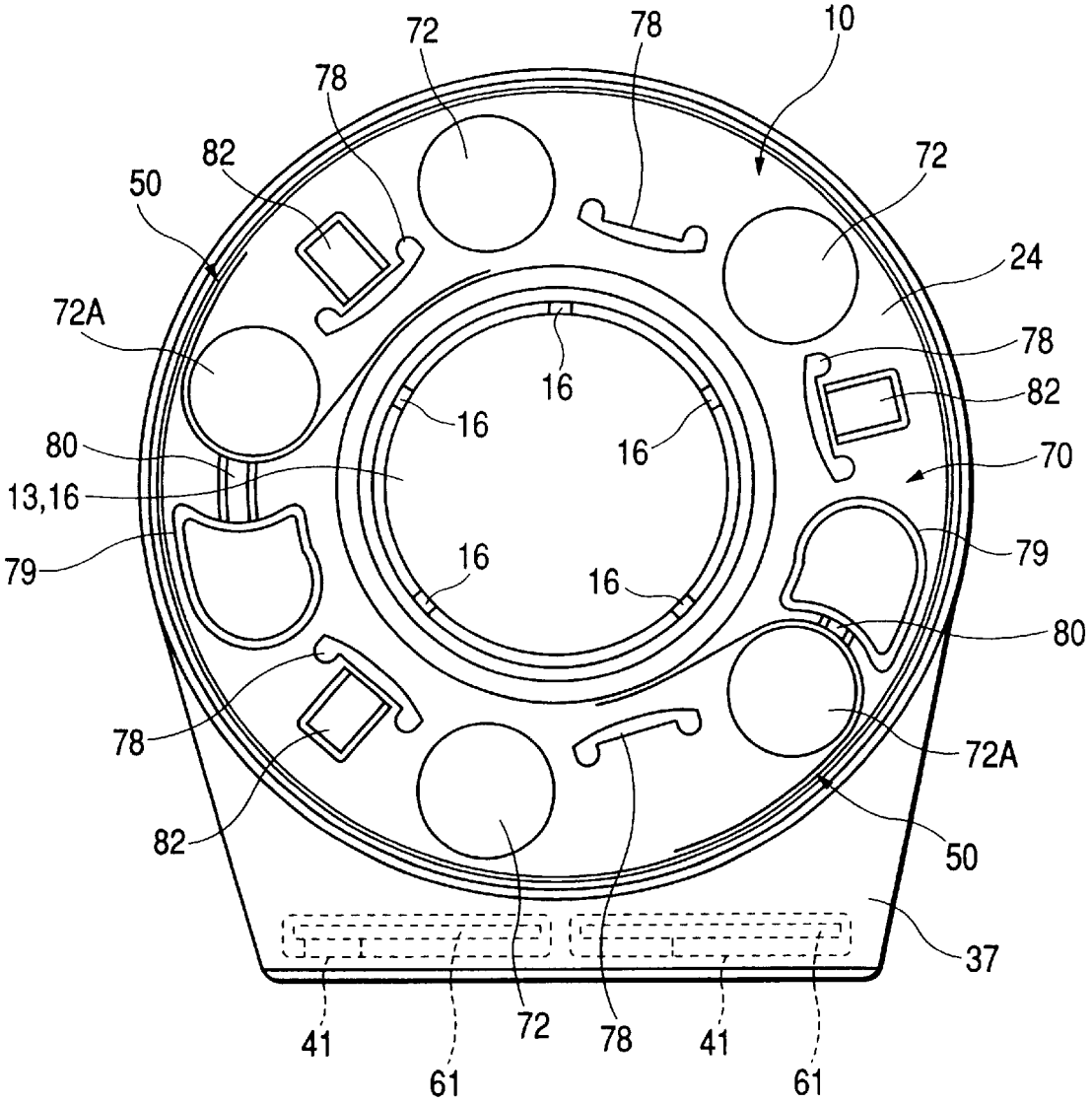
FIG. 3 is a plan view of the rotary connector with a top plate removed.

An entire configuration of a rotary connector according to an embodiment of the present invention will be described hereinunder with reference to FIGS. 1 to 3, of which FIG. 1 is a plan view of the rotary connector, FIG. 2 is a sectional view taken on line 2—2 in FIG. 1, and FIG. 3 is a plan view of the rotary connector with a top plate removed.

As shown in FIGS. 1 and 2, the rotary connector of this embodiment is mainly composed of a first housing 10, a second housing 30 mounted to the first housing 10 rotatably, flexible cables 50 received in a windable and rewindable manner into an annular receptacle portion 24 which is formed by combining both housings 10 and 30 with each other, lead blocks 60 and 61 connected to both end portions of the flexible cables 50, and a moving member 70 disposed rotatably within the receptacle portion 24.

The first housing 10 comprises a body 11 and a rotor snap 12 which is snap-fitted to a lower portion of the body 11. The body 11 comprises a top plate 14 having a center hole and formed in a doughnut shape in plan and a first inner cylinder 15 suspended from an inner peripheral portion of the top plate 14. The rotor snap 12 comprises a retaining plate 17 having a center hole 16 and formed in a doughnut shape in plan which is smaller in diameter than the top plate 14 and a second inner cylinder 18 which is erected from an inner peripheral portion of the retaining plate 17.

On an inner peripheral surface of the first inner cylinder 15 are formed a plurality of stoppers 19 for abutment thereagainst of a front end portion of the rotor snap 12 and a plurality of retaining pawls (not shown) for snap-fitting of the rotor snap 12. The rotor snap 12 is snap-fitted to the body 11 of the first housing by bringing the retaining pawls respectively into engagement with retaining holes (not shown) formed in the corresponding portion of the rotor snap 12. Two first lead block setting portions 21 are projected upward from an upper surface of the top plate 14 at predetermined positions, and first lead blocks 60, which are connected to one ends of the flexible cables 50, are received and fixed within the first lead block setting portions 21. Further, an engaging recess 23 of the second housing 30, which will be described later, is formed in a lower surface of an outer peripheral portion of the top plate 14.

The second housing 30 comprises an outer cylinder 31 and a bottom plate 32 which is snap-fitted to a lower portion of the outer cylinder 31.

The outer cylinder 31 defines a space 24 for receiving therein the flexible cables 50 and the moving member 70 between the first and second inner cylinders 15, 18. The outer cylinder 31 has an inside diameter larger than the outside diameter of the first inner cylinder 15 and that of the second inner cylinder 18. At an upper end portion of an inner peripheral surface of the outer cylinder 31 is formed a top plate receiving portion 34 having a ring-like projection 33 for engagement with the retaining recess 23 formed in the top plate 14, while from a lower end portion of an outer peripheral surface of the outer cylinder 31 are projected a plurality of retaining pawls (not shown) for snap-fitting with the bottom plate 32. In part (the lower end portion in FIGS. 1 and 3) of the outer cylinder 31 is formed a second lead block receptacle portion 37 for receiving therein the second lead blocks 61 which are connected to opposite ends of the flexible cables 50.

The bottom plate 32 is formed substantially in the shape of a flat plate having a center hole 38, and a stepped portion 39 is formed in an inner peripheral portion extending along the center hole 38 to receive an outer peripheral portion of the retaining plate 17 of the rotor snap 12. Centrally of an upper surface of the bottom plate 32 is formed a ring-like concave groove 40 for engagement therein of the moving member 70, while from a lower surface of the bottom plate are projected two second lead block setting portions 41 downward at a position corresponding to the second lead block receptacle portion 37, with connecting pins 61*a* of the second lead blocks 61 being received and fixed within the setting portions 41.

The flexible cables 50 each comprise a plurality of conductors laminated using an insulating cover sheet, which conductors are connected respectively to the connecting pins 60*a* and 61*a* of the first and second lead blocks 60, 61 attached to both end portions of the flexible cable. In this embodiment, two flexible cables 50 are wound and received in the receptacle portion 24, as shown in FIG. 3. As to the configuration of the flexible cables 50 and that of the first and second lead blocks 60, 61, a more detailed description will be given later.

As shown in FIGS. 2 and 3, the moving member 70 is made up of a ring-like roller holder 71 capable of being received in the receptacle portion 24 and a plurality of rollers 72 secured to the roller holder 71 rotatably.

The roller holder 71 has roller setting portions from which are projected roller shafts 74 respectively, the roller shafts 74 each having a retaining pawl 73 formed on an inner surface thereof, as shown in FIG. 2. A cylindrical roller 72 is mounted rotatably on each roller shaft 74. As shown in the same figure, the roller 72 is formed in a cylindrical shape having a top plate. Centrally from a lower surface of the top plate are suspended concentrically an inner cylinder 76 having a retaining pawl engageable with the retaining pawl 73 and an outer cylinder 77 fitted on an outer surface of the associated roller shaft 74. Each roller 72 is mounted on the associated roller shaft 74 by inserting the roller shaft between the inner and outer cylinders 76, 77 and by engaging the retaining pawl 73 formed on the roller shaft 74 with the retaining pawl 75 formed on the inner cylinder 76.

A guide plate 78 for the flexible cables 50 is projected between adjacent roller shafts 74 in the roller holder 71. Next to specific rollers 72A on which the flexible cables 50 are to be wound there are formed projecting portions 79 of a different shape in a spaced relation to each other at a predetermined interval, indicating the positions of the specific rollers 72A.

Further, a through hole 80 is formed in the portion from a vicinity of each of the roller shafts 74 with the specific rollers 72A mounted thereon up to the associated projecting portion 79 to check whether the flexible cables 50 have been wound round on the specific rollers 72A each in a predetermined direction.

The reference numeral 82 appearing in FIGS. 2 and 3 denotes an elastic piece engaged with the annular concave groove 40 formed centrally of the upper surface of the bottom plate 32. Plural elastic pieces 82 are formed at nearly equal intervals in the roller holder 71.

The elastic pieces 82 are formed by cutting the roller holder 71 in three positions and elastically deforming free ends of the thus-cut portions downwards. At the tip of a lower surface of each elastic piece 82 is formed a prong 83 engageable with the concave groove 40. By bringing the prongs 83 formed at the tips of the elastic pieces of the roller holder 71 into engagement with the ring-like concave groove 40 formed in the bottom plate 32, there is ensured a stable rotational motion in the space 24.

Figure 4:
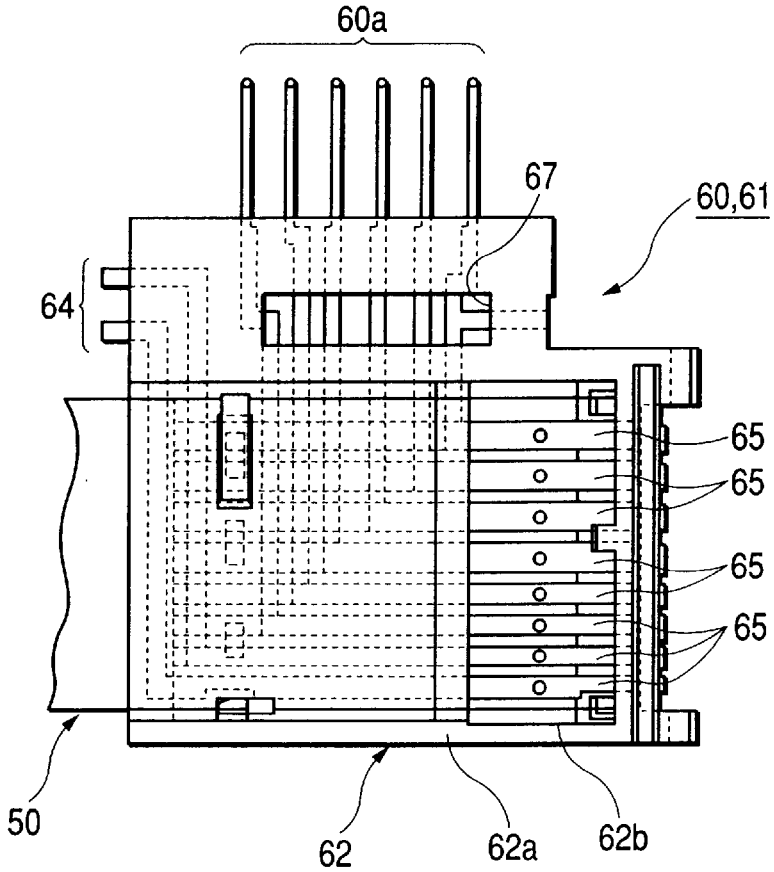
FIG. 4 is a plan view of a lead block with a flexible cable connected thereto.
Figure 5:
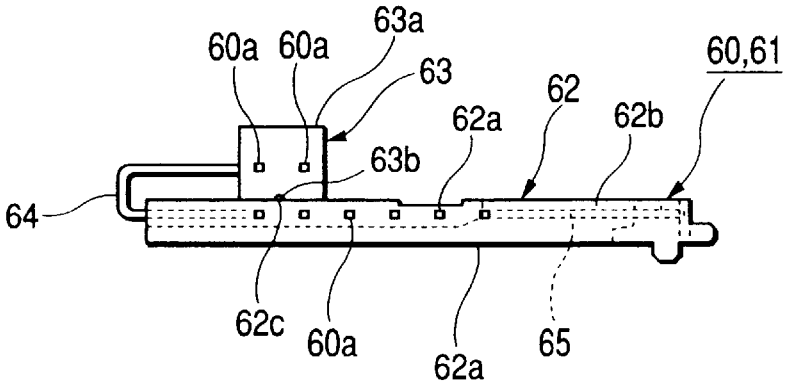
FIG. 5 is a side view of an output terminal side of the lead block shown in FIG. 4.
Figure 6:
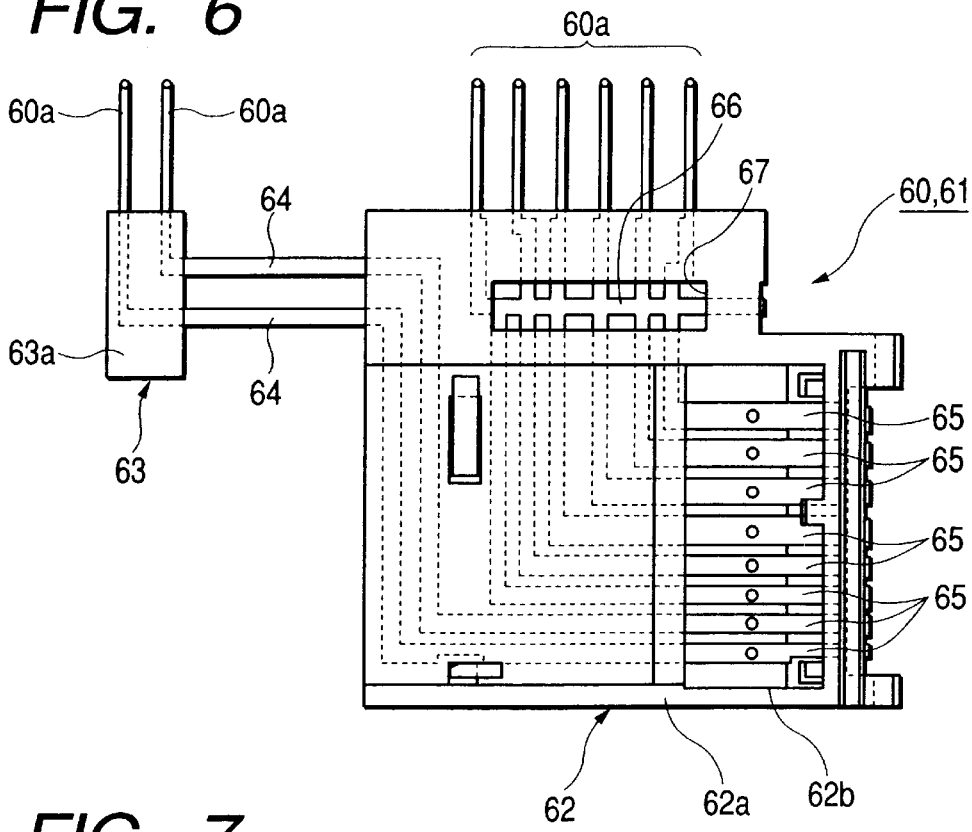
FIG. 6 is a plan view of the lead block shown in FIG. 4 before bending and cutting work.
Figure 7:
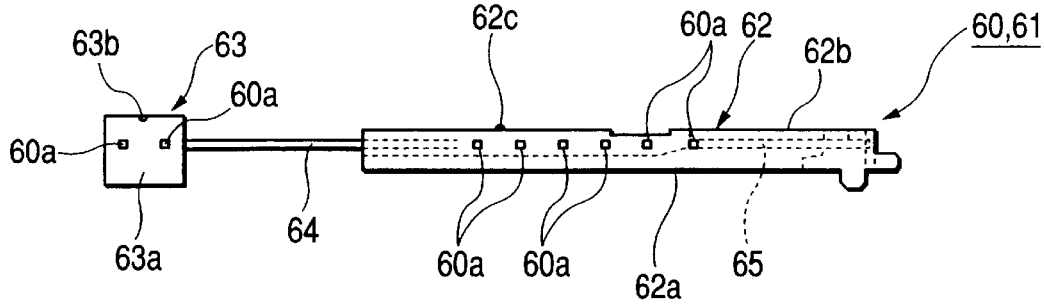
FIG. 7 is a side view of the output terminal side of the lead block shown in FIG. 6.
Figure 8:
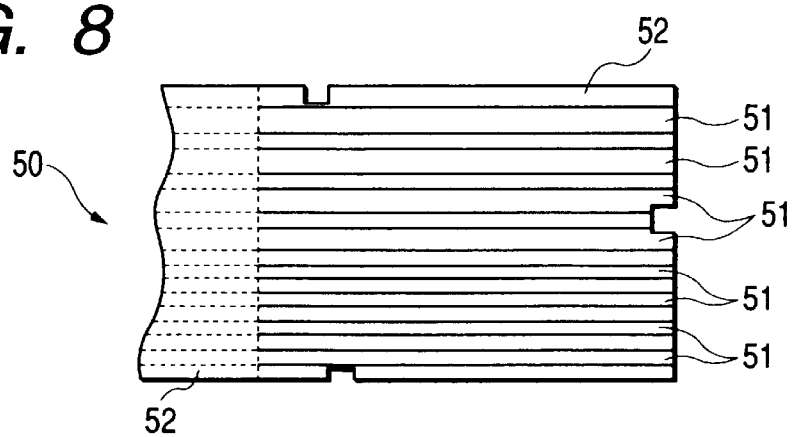
FIG. 8 is a plan view of an end portion of the flexible cable.

Now, with reference to FIGS. 4 to 8, the following description is provided about the structure of the flexible cables 50 and that of the first and second lead blocks 60, 61 used in the rotary connector of this embodiment. FIG. 4 is a plan view of a lead block with a flexible cable connected thereto, FIG. 5 is a side view of an output terminal side of the lead block, FIG. 6 is a plan view of the lead block shown in FIG. 4, prior to bending work, FIG. 7 is a side view of the output terminal side of the lead block shown in FIG. 6, and FIG. 8 is a partial plan view of the flexible cable.

The flexible cables 50 are each a band-like cable obtained by laminating a plurality of parallel conductors (lead wires) 51 with use of two surface and back insulating films 52. In this embodiment there are used eight conductors 51. At both end portions of each flexible cable 50, as shown in FIG. 8, one insulating film is peeled off and a group of conductors 51 are exposed on one side of the other insulating film.

As is seen from FIGS. 6 and 7, the first and second lead blocks 60, 61 are each mainly composed of a body portion 62 having a plurality (six in this embodiment) of connecting terminals 60*a* arranged in a row at predetermined intervals, an extending terminal portion 63 having a plurality (two in this embodiment) of connecting terminals 60*a* arranged in a row at the same intervals as that of the connecting terminals 60*a*, and conductor extending portions 64 which connects the body portion 62 and the extending terminal portion 63 with each other.

The body portion comprises a resin molded portion 62*a* obtained by integrally resin-molding a total of eight conductors 65 integral with the connecting terminals 60*a* and six connecting terminals 60*a* projecting upward from an upper side of the resin molded portion 62*a*. On a surface side (the side where the flexible cable 50 is disposed) of the resin-molded portion 62*a* is provided a flexible cable connecting portion 62*b* in which the eight conductors 65 are exposed to the exterior, while on a back side thereof is formed a lug 62*c* for use as a positioning means to position the extending terminal portion 63 relative to the body portion 62. Although in this embodiment the conductors 65 of a predetermined certain width are exposed at predetermined certain intervals in the flexible cable connecting portion 62*b*, the width of each conductor 65 and intervals between adjacent conductors may be changed according to the width and intervals of the conductors carried in the flexible cable 50.

The body portion 62 may be subjected to resin molding, which is conducted simultaneously with the resin molding of the extending terminal portion 63, in the following manner. For enhancing the rigidity of the connecting terminals 60*a* and facilitating the handling thereof, resin molding is performed for a required portion in an integral condition of the connecting terminals 60*a* through a connector piece 66 and thereafter a cutting jig (not shown) is inserted through a window hole 67 formed in the resin molded portion 62*a* to cut the connector piece 66, thereby making the connecting terminals 60*a* independent of one another electrically.

The extending terminal portion 63 is provided at front end portions of the conductor extending portions 64, the conductor extending portions 64 being formed by extending two conductors 65 other than six conductors 65 integral with the six connecting terminals 60*a* in the body portion 62 out of the eight conductors 65 in all formed in the body portion. The extending terminal portion 63 is made up of two connecting terminals 60*a* integral with the two conductor extending portions 64 respectively and a resin molded portion 63*a* in which base portions of the connecting terminals 60*a* are resin-molded integrally. In aback of the resin-molded portion 63*a* is formed a positioning recess 63*b* engageable with the lug 62*c* formed on the back of the body of the body portion 62.

As is apparent from FIGS. 6 and 7, the six connecting terminals 60*a* in the body portion 62 and the two connecting terminals 60*a* in the extending terminal portion 63 are arranged at predetermined certain intervals so that their front end portions are located at the same height.

Each lead block 60 (61) and each flexible cable 50 can be connected together in such a manner as shown in FIG. 4. That is, an end portion of the flexible cable 50 is put on the resin-molded portion 62*a* of the body portion 62, then the conductors 51 carried in the flexible cable are aligned respectively with the eight conductors 65 exposed to the flexible cable connecting portion 62*b*, and the conductors 51 and 65 are welded together by spot welding or ultrasonic welding.

In each of the lead blocks 60 and 61 thus constructed and with the flexible cables 50 connected thereto, as shown in FIGS. 4 and 5, the conductor extending portion 64 is bent in U shape, allowing the extending terminal portion 63 to be positioned on the back side of the body portion 62, and in this state the lead block can be attached to the fixed and movable housings which constitute the rotary connector. In this case, by fitting the lug 62*c* formed on the back of the body portion 62 into the recess 63*b* formed in the back of the extending terminal portion 63 it is possible to effect positioning of the extending terminal portion 63 relative to the body portion 62 accurately.

How to use the rotary connector of this embodiment constructed as above, as well as the operation thereof, will be described below with respect to the case where the second housing 30 in the rotary connector is used as a fixed housing, while the first housing 10 is used as movable connector, and the rotary connector is attached to a vehicular steering system.

First, the first housing 10 is fixed to a steering wheel of a vehicle and the second housing 30 is fixed to a steering column of the vehicle. Next, external connectors (not shown) provided on a rotor side are inserted into the first lead blocks 60, while external connectors (not shown) provided on a stator side are inserted into the second lead blocks 61.

In this state, if the vehicular steering wheel is turned clockwise or counterclockwise, the first housing 10 to which the turning force of the steering wheel is transmitted also turns in the same direction, whereby the flexible cables 50 are rewound or wound. For example, if the steering wheel is turned clockwise from its neutral position and the first housing 10 turns in the same direction, the flexible cables 50 are unwound from the first housing 10, so that the cables are gradually wound while being pressed against the second housing 30 and assume a rewound state.

Conversely, when the steering wheel is turned counterclockwise from its neutral position and the first housing 10 turns in the same direction, the flexible cables 50 are unwound gradually from the second housing 30 while their turn-around portions push in the specific rollers 72A in the same direction. Consequently, the flexible cables 50 are wound gradually along the first housing 10 and thus assume a wound state.

Thus, in the rotary connector of this embodiment, the lead blocks 60 and 61 are each made up of the body portion 62, the extending terminal portion 63, and the conductor extending portions 64 capable of being subjected to bending, the connecting portion 62*b* for each flexible cable 50 is formed in only the body portion 62, and the conductors 65 are disposed in the connecting portion 62*b* in the same arrangement as that of the conductors 51 carried in each flexible cable 50. Therefore, the conductor 51 carried in the cable 50 and the conductors 65 held in each of the lead blocks 60 and 61 can be connected together without dividing an end portion of the cable. In this way the connection of the flexible cables 50 to the lead blocks 60 and 61 can be done in a simple and reliable manner.

In the rotary connector of this embodiment, moreover, the lead blocks 60 and 61 are each made up of the body portion 62, the extending terminal portion 63, and the conductor extending portions 64 capable of being subjected to bending, a predetermined number of output terminals 60*a* are distributed to the body portion 62 and the extending terminal portion 63, and the conductor extending portions 64 are bent so that the extending terminal portion 63 can be disposed along the body portion 62 and on the back side of the body portion. Therefore, it is possible to increase the total number of connecting terminals 60*a* without increasing the number of lead blocks, and the connecting work for connecting external connectors to the lead blocks is not likely to become complicated at all.

In the lead blocks 60 and 61 used in this embodiment, since resin-molded portions are provided in the body portion 62 and the extending terminal portion 63, the connecting terminals 60*a* can be held at predetermined certain intervals and this is convenient for use.

In the lead blocks 60 and 61 used in this embodiment, moreover, since a positioning means comprising the lug 62*c* and the recess 63*b* is provided between the body portion 62 and the extending terminal portion 63, it is possible to effect positioning of the extending terminal portion 63 accurately with respect to the body portion 62. Consequently, it is possible to establish an accurate positional relation of the connecting terminals 60*a* provided in each of the body portion 62 and the extending terminal portion 63.

Although in the above embodiment only one extending terminal portion 63 is formed and the connecting terminals provided in the body portion 62 and those provided in the extending terminal portion 63 are arranged in two rows, two or more extending terminal portions 63 may be formed on both sides of the body portion 62 and the connecting terminals provided in the body portion 62 and those provided in the two or more extending terminal portions 63 may be bent to the front and back sides of the body portion 62 so as to be arranged in three or more rows.

Although resin-molded portions are provided in the body portion 62 and he extending terminal portion 63 respectively, the resin-molded portion 63*a* provided in the extending terminal portion 63 may be omitted.

Although in the above embodiment the extending terminal portion 63 is folded back to the back side of the body portion 62, the bent shape of the conductor extending portions 64 is not limited thereto. The conductor extending portions 64 may be bent in a desired shape such as a 90°-bent shape or a 60°-bent shape.

Although in the above embodiment the lead blocks 60 and 61 connected to both end portions of the flexible cables 50 are of the same configuration and shape, they may be of other different configurations and shapes. It is not always necessary to connect lead blocks to both ends of the flexible cables 50. Lead blocks may be connected to only one ends of the flexible cables.

Further, although in the above embodiment external connectors are connected to one ends of the lead blocks 60 and 61, external leads may be connected to the conductors 65 formed in the lead blocks 60 and 61, whereby the conductors 51 carried in the flexible cables 60 and 61 can be drawn out to the exterior electrically.

The rotary connector according to the present invention, which is applied in such a mode of embodiment as described above, exhibits the following effects. Since the lead blocks are each composed of a body portion, an extending terminal portion, and conductor extending portions capable of being subjected to bending and a flexible cable connecting portion is provided in only the body portion, it is possible to effect connection between the conductors carried in each flexible cable and the conductors held in each block without dividing an end portion of the cable, thus making it possible to connect the flexible cable to the lead block in a simple and reliable manner. Besides, since a predetermined number of output terminals are distributed to the body portion and the extending terminal portion and the extending terminal portion can be disposed on the back side of the body portion by bending the conductor extending portions, it is possible to increase the total number of connecting terminals without increasing the number of lead blocks.

Moreover, since resin-molded portions are provided in the body portion and the extending terminal portion respectively and connecting terminals or a group of connecting terminals are projected from part of the resin-molded portions, the connecting terminals can be spaced at a constant interval, which is convenient for use.

Further, since the connecting terminals are projected at a constant pitch from the resin-molded portions in the body portion and the extending terminal portion, it is possible to simplify the structure of external connectors and facilitate connection of the external connectors to each lead block.

Further, since the extending terminal portion is folded back to the back side of the body portion and the connecting terminals arranged in a row in the body portion and those arranged in a row in the extending terminal portion are made parallel to each other, it is possible to use external connectors which are available commercially, and thus a rotary connector having a large number of circuits can be provided less expensively.

Further, since a positioning means for positioning the extending terminal portion relative to the body portion is provided between the body portion and the extending terminal portion, it is possible to effect positioning of the extending terminal portion accurately with respect to the body portion at the time of folding back the extending terminal portion along the body portion and hence possible to establish an accurate positional relation of the connecting terminals provided in the body portion and the extending terminal portion.

Further, since a group of conductors in a number corresponding to the number of conductors carried in each flexible cable are arranged in the flexible cable connecting portion of each lead block flushly at intervals corresponding to the intervals of conductors carried in the flexible cable, it is possible to effect connection between the conductors carried in the flexible cable and the conductors held in the lead block in a simpler and more reliable manner.

What is claimed is:

1. A rotary connector comprising:

a pair of housings disposed concentrically and connected together in a relatively rotatable manner;

a flexible cable received in a windable and rewindable manner within a space formed between the paired housings; and a lead block connected to an end portion of the flexible cable and held at a predetermined position of the housings, the lead block comprising a body portion, a conductor extending portion projecting from the body portion, and an extending terminal portion, the body portion having a flexible cable connecting portion as a connection of conductors carried in the flexible cable and a group of connecting terminals integral with some of the conductors which constitute the connecting portion, the conductor extending portion being integral with some of the remaining conductors which constitute the connecting portion, and the extending terminal portion having a connecting terminal which constitute the conductor extending portion, the conductor extending portion being folded back such that the extending terminal portion is positioned along the body portion, and the connecting terminals in the body portion and the connecting terminals in the extending terminal portion are arranged each in a row and in parallel with each other.

2. A rotary connector according to claim 1, wherein resin-molded portions are provided respectively in the body portion and the extending terminal portion, and the connecting terminals are projected from part of the resin-molded portions.

3. A rotary connector according to claim 2, wherein the group of connecting terminals is projected at a constant pitch from the resin-molded portions provided in the body portion and the extending terminal portion.

4. A rotary connector according to claim 1, wherein a positioning mechanism to position the extending terminal portion relative to the body portion is provided between the body portion and the extending terminal portion.

5. A rotary connector according to claim 1, wherein conductors in a number corresponding to the number of conductors carried in the flexible cable are arranged in the flexible cable connecting portion of the lead block flushly and at intervals corresponding to the intervals of the conductors carried in the flexible cable.

6. A rotary connector according to claim 1, wherein the body portion is resin-molded and includes a first group of connecting terminals and the extending terminal portion is resin-molded and includes a second group of connecting terminals.

7. A rotary connector according to claim 6, wherein connecting terminals of each of the first and second groups of connecting terminals are arranged to project at predetermined intervals from the body portion and the extending terminal portion, respectively.

* * * * *